US005923346A

United States Patent [19]

Mills et al.

[11] Patent Number: 5,923,346

[45] Date of Patent: Jul. 13, 1999

[54] SHADOW PULSE COMPENSATION OF AN INK JET PRINTER

[75] Inventors: Ross Neal Mills; James Elwood Kerr, both of Boulder; Jon-Christophe Bernard Febvre, Ft. Collins, all of Colo.

[73] Assignee: imaging Technology international, Boulder, Colo.

[21] Appl. No.: 08/551,907

[22] Filed: Oct. 23, 1995

[51] Int. Cl.[6] ..... B41J 2/065; B41J 2/205

[52] U.S. Cl. ..... 347/11; 347/10; 347/12; 347/15; 347/55

[58] Field of Search ..... 347/55, 13, 12, 347/9, 10, 11, 40, 15, 78

[56] References Cited

U.S. PATENT DOCUMENTS

| | | | |
|---|---|---|---|
| 3,911,448 | 10/1975 | Ohno et al. | 347/3 |
| 4,074,278 | 2/1978 | Robertson | 347/76 |
| 4,752,783 | 6/1988 | Saito et al. | 347/55 |
| 5,021,803 | 6/1991 | Toms et al. | 347/75 |
| 5,142,296 | 8/1992 | Lopez et al. | 347/12 |
| 5,270,729 | 12/1993 | Stearns | 347/128 |

FOREIGN PATENT DOCUMENTS

| | | | |
|---|---|---|---|
| 1-204750 | 8/1989 | Japan | 347/55 |
| 2-067143 | 3/1990 | Japan | 347/55 |

*Primary Examiner*—David F. Yockey
*Attorney, Agent, or Firm*—F. A. Sirr; E. C. Hancock; Holland & Hart llp

[57] ABSTRACT

In an electrostatic ink jet printer, all nozzles of a printhead are spaced generally the same distance from a moving paper print substrate. Three voltage levels are selectively applied to each nozzle of the printhead. As the paper moves past the printhead, a bias voltage Vb is applied to all nozzles which have a static protruding meniscus which shape is determined by a balance between the internal pressure, surface tension, and bias voltage. When the paper arrives at a print row, nonprinting nozzles have a shadow voltage pulse Vs, the "shadow pulse," applied thereto, and printing nozzles have a higher magnitude print pulse Vp applied thereto. The magnitude of the shadow pulse Vs causes an additional excursion of the ink meniscus to form at each non-printing nozzle. The higher magnitude of print pulse Vp causes an ink filament to move from a printing nozzle to the paper. The time duration of each print pulse is varied in accordance with an ink density parameter up to a range that is determined by the duration of the shadow pulse. The electrostatic field difference between nonprinting and printing nozzles (Vp–Vs) is of a low magnitude that inhibits ink filament deflection and ink volume differences due to crosstalk between nozzles.

21 Claims, 19 Drawing Sheets

SHADOW PULSE COMPENSATION OF AN INK JET PRINTER

BACKGROUND OF THE INVENTION

1. Field of the Invention

This invention relates to the field of electrostatic ink jet printers, and more particularly to voltage supply means that operates to apply a print voltage between a printhead and a print substrate, to thereby selectively cause drops of ink to move on demand from selected nozzles of the printhead to the print substrate in accordance with the digital content of a print data source.

2. Description of the Related Art

The fact that liquid will deform in the presence of an electrostatic field has been known for some time. The term "Taylor cone" has been used to describe the geometric shape that results from the balance of electrostatic force, surface tension force, and internal pressure force that acts on small volume of liquid that is exposed to an electrostatic field. The electrostatic field attempts to pull atoms of the liquid out along the electrostatic field gradient, while surface tension at the same time attempts to hold the liquid in a flat state. Both of these forces are inversely proportional to the square of the radius of curvature of the liquid surface. The sharper the curvature of the liquid surface, the greater the electrostatic field attempts to pull the liquid out, and the greater the surface tension attempts to restore the liquid to a flat state. The result is a conical liquid shape having a half-angle of about 49.3-degrees, this angle being independent of liquid properties.

At the tip of an idealized Taylor cone, both of these forces become infinite. However, before this occurs in actual practice, a thin filament of liquid is drawn out of the tip of the cone along the electrostatic field gradient. It is this phenomenon that forms the basis of electrostatic, or electrohydrodynamic drop-on-demand ink jet printing, sometimes referred to as ESIJET or "easy jet".

As is well known to those of skill in the art, this ink filament does not form until the electrostatic field intensity has reached a given level. The particular level at which the ink filament forms is known to be a function of the geometry of the filament nucleation site, the physical separation between the nucleation site and the opposite electrode, and the physical and electrical properties of the ink. However, when these variables are fixed, as they are in a printer that is manufactured to a exact engineering specification, the threshold level (Et) at which an ink filament forms is constant and well behaved. Exposure of a nucleation site (i.e., an ink jet nozzle) to an electrostatic field only slightly higher in magnitude, than Et will produce an ink filament that travels in a generally straight line from the nucleation site to the opposite electrode. Exposure of a nucleation site to an electrostatic field only slightly below the magnitude Et will cause the nozzle's ink meniscus to deform, but an ink filament is not produced.

FIG. 1 represents a prior arrangement having five ink jet nucleation sites or nozzles 10–14 that are supported in a line (by means not shown) to form a linear printhead 20 that is located generally a uniform distance above a moving print substrate 15. Substrate 15 is usually nonconductive paper that moves in the Y-direction normal to the X-direction line of nozzles 10–14. In FIG. 1, nozzle 12 is selected for printing by providing a print pulse 16, of a magnitude Vp to nozzle 12 by way of conductor 3, as a bias voltage of a magnitude Vb is applied to all other nozzles.

A typical magnitude for voltage Vb for practical nozzle separation distance of about 1 mm is about 800 to about 1,200 V DC above the ground potential of plate 17. For voltage Vp, a typical magnitude is about 450 to about 800 V DC above the magnitude of voltage Vb.

Voltages Vp and Vb are applied between the respective nozzles 10–14 and the opposite electrode 17, usually a grounded metal plate. As can be seen in FIG. 1, ink filament 18 travels undeflected to paper substrate 15.

In FIG. 2, a print pulse 16 is again applied to nozzle 12, as a print pulse 19 is concomitantly applied to nozzle 13. The result is that both of the resulting ink filaments 18 and 21 are deflected from their desired points of impact on paper 15 due to the interaction of their respective electrostatic fields.

In a like manner, it is observed that when a print pulse is applied to only nozzles 11 and 13, for example, neither ink filament is significantly deflected; i.e., both filaments travel, as shown in FIG. 1. If the bias voltage and/or print voltage were to be increased and/or the same voltages were applied to more closely spaced nozzles, an electrostatic field interaction and resultant ink filament deflection would take place. However, when nozzles 10, 12 and 14 are activated, the filament that issues from nozzle 12 travels undeflected, as shown in FIG. 1, but the two ink filaments that issue from nozzles 10 and 14 are both deflected outward due to edge effects which result from the absence of a neighboring nozzle; i.e., deflected in a direction away from the adjacent nozzles 11 and 13 that have the bias voltage Vb applied thereto.

It is also observed that when a print pulse is applied to only nozzles 10, 11 and 14, for example, all three ink filaments are deflected, the ink filaments from nozzle 10 deflecting due to bias and print voltage applied to nozzle 11, and the ink filament from nozzle 14 deflecting outward as above described, as the ink filament from nozzle 11 is deflected toward non-printing nozzle 12. However, if in this situation, nozzle 12 also becomes a printing nozzle, then the ink filament that issues from nozzles 11 will not be deflected, and the ink filament that issues from nozzle 12 will be deflected. However, if in this same situation, nozzle 13 also becomes a printing nozzle, then the three ink filaments that issue from nozzles 11, 12 and 13 are not substantially deflected, but the outward deflection of the ink filaments from nozzle 10 and 14 is more pronounced due to the combination of edge effects and crosstalk.

The ink filament "crosstalk" effect is a function of electrostatic field interaction due to differences in applied voltages and, more specifically, the difference in the electrostatic field that is experienced by an ink filament nucleation site when the site is acting alone, versus the electrostatic field that this nucleation site experiences when a jetting, or print voltage Vp, is applied to one or more of its neighbor nucleation sites, or when this nucleation site has no neighbor on one or more sides. The greater the difference between the acting-alone electrostatic field and the acting-together electrostatic field, the more pronounced will be the ink filament deflection effects and ink volume differences due to crosstalk.

While the present invention will be described making reference to a linear printhead of the type shown in FIGS. 1 and 2, the invention finds utility in a more complex printhead wherein the nozzles of the printhead are arranged in a plane; for example, an X-Y matrix of ink jet nozzles. In this two-dimensional arrangement, the ink jet nozzles that are located at the border of this more complex printhead experience the same deflection characteristics as do the end nozzles 10 and 14 of FIGS. 1 and 2.

SUMMARY OF THE INVENTION

This invention provides a drop-on-demand electrostatic ink jet printer wherein a voltage equal to, or above, a given print level Vp must be applied to any given nozzle(s) to cause a drop(s) or filament(s) of ink to issue from the given nozzle(s), and then impact a moving print substrate such as paper.

This voltage pulse applied to each nozzle from which a drop of ink is required in accordance with a print data control input. A shadow voltage pulse Vs is applied to all other of the nozzles. The magnitude of this shadow pulse Vs is high enough to reduce the magnitude of an electrostatic field differences that exist between printing nozzles and non-printing nozzles, but at the same time, the magnitude of this shadow pulse Vs is low enough to prevent the issuance of ink drops from the non-printing nozzles.

In this manner, the difference in the electrostatic fields between printing and non-printing ink filament nucleation sites is appreciably reduced, and the crosstalk ink volume differences and the crosstalk deflection of ink filaments moving from the printhead to the paper is substantially eliminated.

A unique printhead electronic network comprising a power supply module, a data interface module, and a shadow pulse module is provided, whereby low magnitude power supply voltages, low magnitude logic-level control voltages, and high magnitude nozzle print/no-print voltages are level shifted as they progress through the network, thus allowing semiconductor circuits to be used to switch these voltages of different magnitudes.

These and other objects, features and advantages of the invention will be apparent to those of skill in the art, upon reference to the following detailed description of preferred embodiments of the invention, which detailed description makes reference to the drawing.

DESCRIPTION OF THE PREFERRED EMBODIMENTS

The present invention relates to a drop-on-demand electrostatic ink jet printer wherein the force-balance that is provided by electrostatic force, surface tension force and internal liquid pressure forces acts on a plurality of small liquid ink volumes that are contained within a like plurality of closely-spaced nozzles. All of the nozzles are spaced generally the same distance from a print substrate such as paper. A voltage above a given level must be applied to any given nozzle(s) to cause a drop(s), or filament(s) of ink to issue from the given nozzle(s), and then impact the print substrate.

In accordance with this invention, a voltage pulse Vp whose magnitude is equal to, or above this given printing level, is applied to each nozzle from which a drop of ink is required in accordance with print data, and a shadow voltage pulse Vs is applied to all other of the nozzles. The magnitude of this shadow pulse Vs is critical in that it is high enough to reduce the magnitude of an electrostatic field difference that exists between printing nozzles and non-printing nozzles, while at the same time, the magnitude of this shadow pulse Vs is low enough to prevent the issuance of ink drops from the non-printing nozzles.

In this manner, the difference in the electrostatic fields among printing and non-printing ink filament nucleation sites is appreciably reduced, and the crosstalk ink volume differences and the crosstalk deflection of ink filaments moving from the printhead to the paper is substantially reduced.

Figure 1:
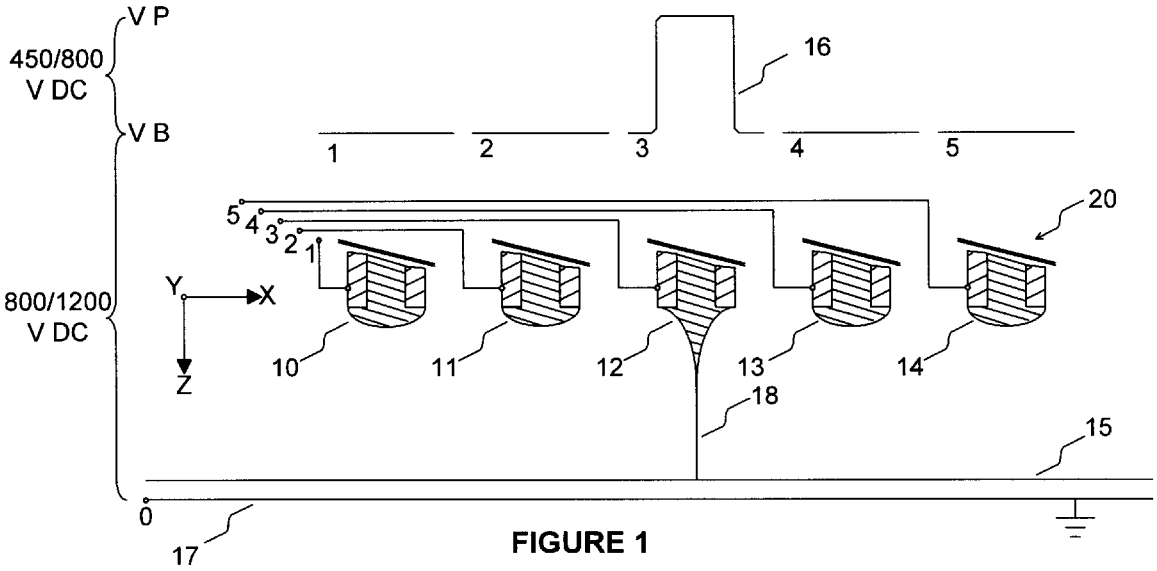
FIGURE 1 PRIOR ART
FIG. 1 shows a five-nozzle ink jet printhead of the general type with which the present invention finds utility, this printhead having a print voltage Vp applied to all printing nozzles, and having a bias voltage Vb applied to all non-printing nozzles.
Figure 2:
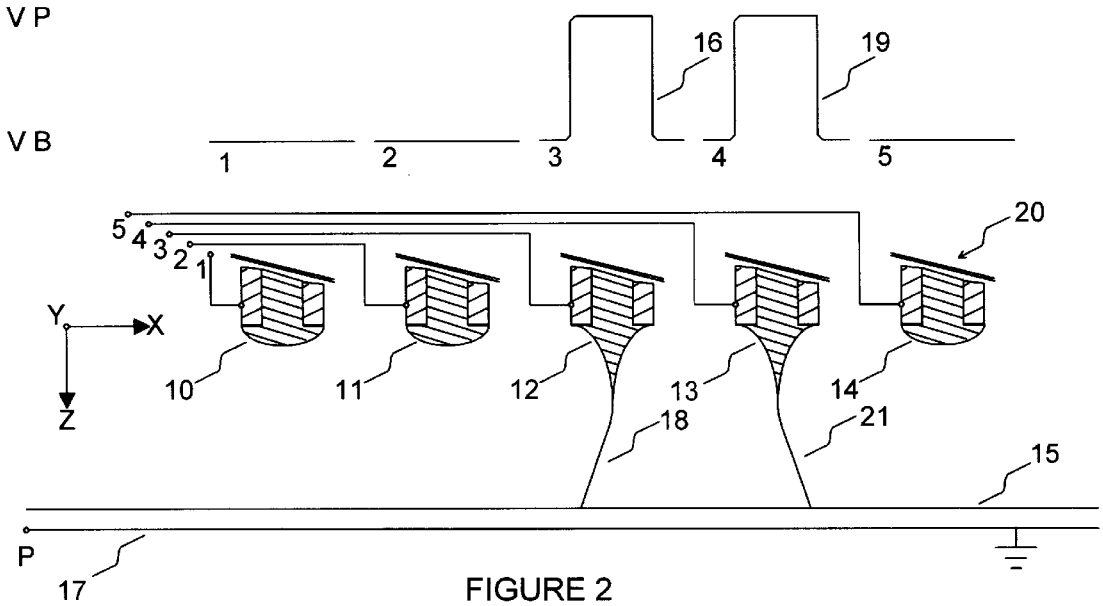
FIGURE 2 PRIOR ART
FIG. 2 shows the printhead of FIG. 1 in a different print state.
Figure 3:
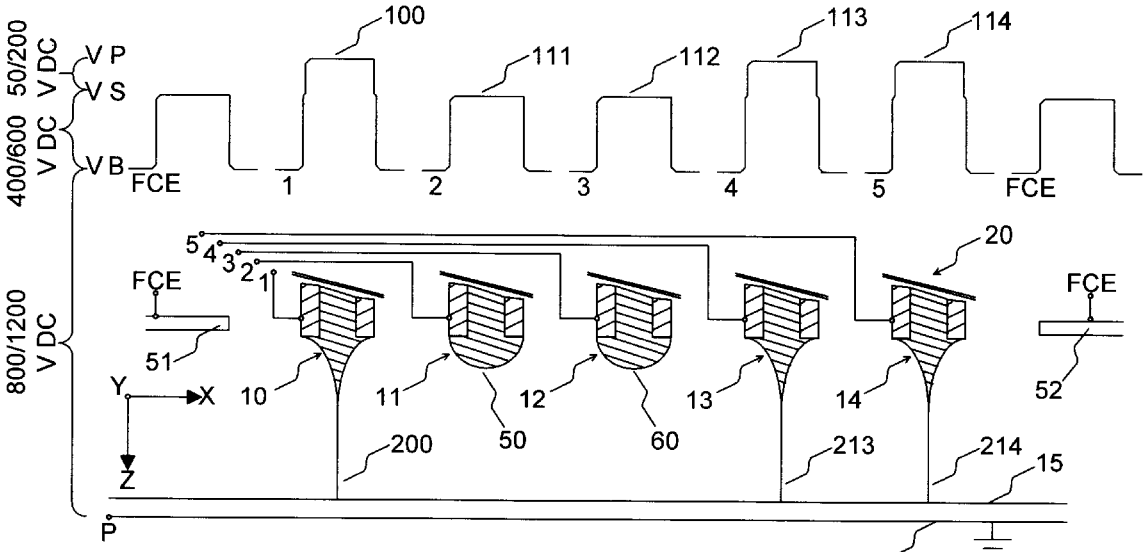
FIG. 3 shows the present invention as it is applied to the five-nozzle ink jet head that is shown in FIG. 1.

FIG. 3 is a showing of the present invention applied to the five-nozzle ink jet head 20 that is shown in FIG. 1.

In FIG. 3, the voltage Vb corresponds generally in magnitude to the like identified voltage of FIG. 1; i.e., it is of a magnitude of from about 800 to about 1,200 V DC relative to ground potential.

In FIG. 3, a shadow pulse voltage Vs is provided. The magnitude of this shadow pulse is about 400 to about 600 V DC above the magnitude of voltage Vb. Also, in this case, the print voltage pulse Vp is of a magnitude about 50 to about 200 V DC above the magnitude of shadow pulse Vs.

In addition, the end or border two nozzles 10 and 14 have a conductive field compensation electrode FCE located closely adjacent thereto, so as to simulate the presence of a voltage biased nozzle on the outward side of each of the two end nozzles 10 and 14, and a voltage shadow pulse Vs is applied to FCE 51,52 whenever a border ink jet nozzle has the print voltage Vp applied thereto, and/or the shadow voltage Vs applied thereto.

In the print situation shown in FIG. 3, the three nozzles 10, 13, 14 are selected for printing by a source of print data (not shown). As a result, print voltage pulses 100, 113, 114 are applied to nozzles 10,13,14. An exemplary magnitude of these print voltage pulses 100, 113, 114 is about 1,250 V DC relative to the ground potential of plate 17 (i.e., 800 V DC+400 V DC+50 V DC).

At the same time that this print voltage Vp is applied to nozzles 10, 13, 14, a shadow pulse 111, 112 is applied to non-printing nozzles 11 and 12, respectively. An exemplary magnitude of this shadow pulse voltage Vs is about 1,200 V DC relative to the ground potential of plate 17 (i.e., 800 V DC+400 V DC).

The magnitude of print pulses 100, 113, 114 relative to the ground potential of plate 17 is such that an ink filament 200, 213, 214 is produced from each of the nozzles 10, 13, 14, respectively. However, the lower magnitude of shadow pulses 111, 112 relative to the ground potential of plate 17 is such as to cause only a meniscus 50 and 60 to form at nozzles 11, 12, respectively.

Since the voltage difference that exists between a non-printing nozzle, such as 11, and its adjacent printing nozzle 10 is only 50 V DC (i.e., 1,200 V DC−1,250 V DC), no significant deflection of the ink filament that issues from the printing nozzle occurs.

In addition, the two FC electrodes 51 and 52 that are adjacent to the two end nozzles 10 and 14, respectively, have a shadow pulse Vs applied thereto coincident with the application of a print voltage pulse Vp to these two end nozzles 10 and 14. In this way, these two printing nozzles 10, 14 experience the same adjacent-nozzle-field as does nozzle 13, and the ink filaments 200 and 214 issuing therefrom are likewise not substantially deflected.

Figure 4:
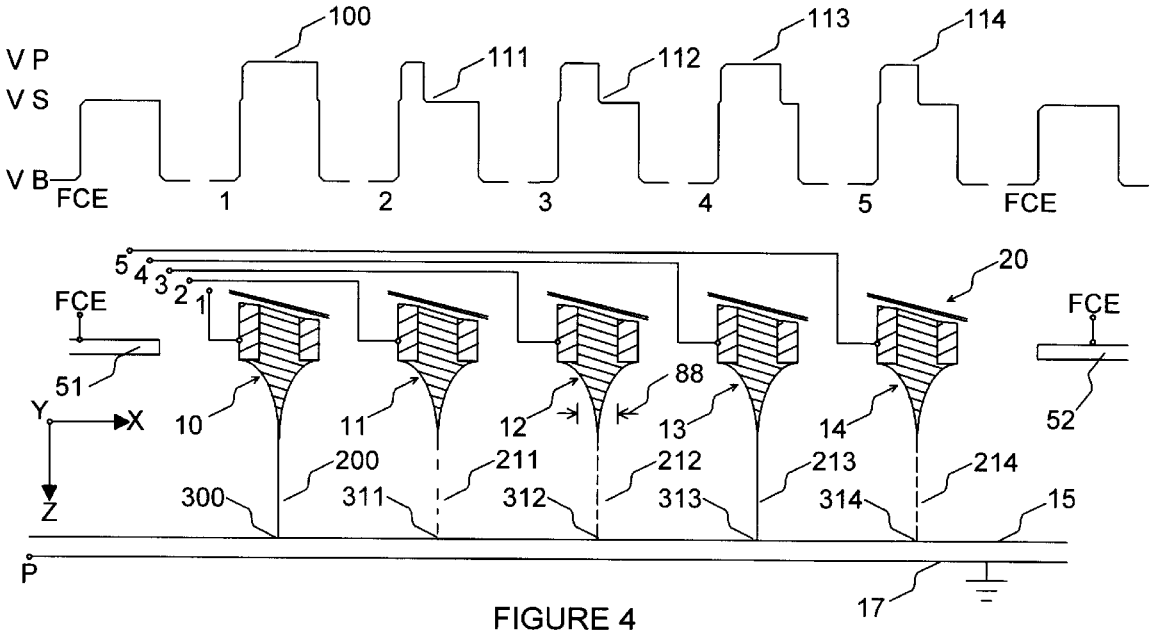
FIG. 4 shows the printhead of FIG. 3 with all five nozzles selected for printing, wherein the print voltage pulse that is applied to a nozzle is of a time duration that is related to the quantity of ink that is to be deposited on a pixel of the paper in accordance with an ink-quantity parameter that is contained within the print data that drives the printhead of FIG. 4.

FIG. 4 is a showing of the printhead of FIG. 3 wherein all five nozzles are selected for printing, and wherein the print voltage pulse Vp that is applied to a nozzle is of a time duration that is related to the quantity of ink that is to be deposited at a pixel on the paper 15, in accordance with an ink-quantity parameter that is contained within print data that drives the printhead of FIG. 4.

In FIG. 4, the voltage magnitudes Vb, Vs and Vp corresponds generally in magnitude to the like identified voltages of FIG. 3.

In this case, all five nozzles 10–14 have been selected for the printing of five adjacent pixels on paper 15, thus all five nozzles have a print pulse Vp applied thereto, as the two end FCEs 51,52 concomitantly have a shadow pulse Vs applied thereto.

The print data that drives printhead 20 in this case includes an ink-quantity parameter that specifies that the five ink filaments 200, 211, 212, 213, and 214 that issue from the five nozzles 10–14 must print dots or pixels of variable density, and that these five dots must range in the following order from the most dense dot to the least dense dot, 300, 313, 312/314, 311.

In order to accomplish this variable dot density function, the most dense dot 300 is formed by ink filament 200 whose nozzle 10 is controlled by a print pulse 100 having a relatively long time duration equal to that shown in FIG. 3. The next lesser density dot 313 is formed by ink filament 213 whose nozzle 13 is controlled by a somewhat shorter time duration print pulse 113. In like manner, the next lesser density dots 312 and 314 are each formed by ink filaments 212 and 214 whose nozzles 12 and 14 are controlled by yet shorter time duration print pulses 112 and 114. The least dense dot 311 is formed by ink filament 211 whose nozzle 11 is controlled by a print pulse Vp of the shortest time duration 111. In principle, any dot density or spot size, from a minimum, as determined by the onset threshold, up to a maximum, as determined by the shadow pulse duration, can be achieved.

Figure 5:
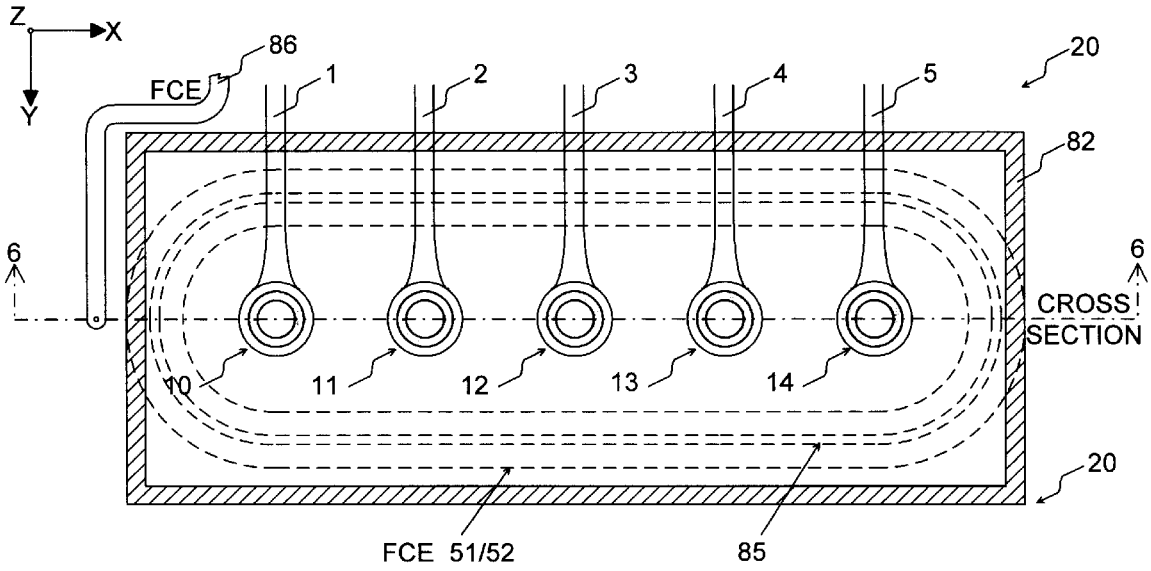
FIG. 5 is a top view of the printhead of FIGS. 3 and 4 taken in the X-Y plane of FIGS. 3 and 4.
Figure 6:
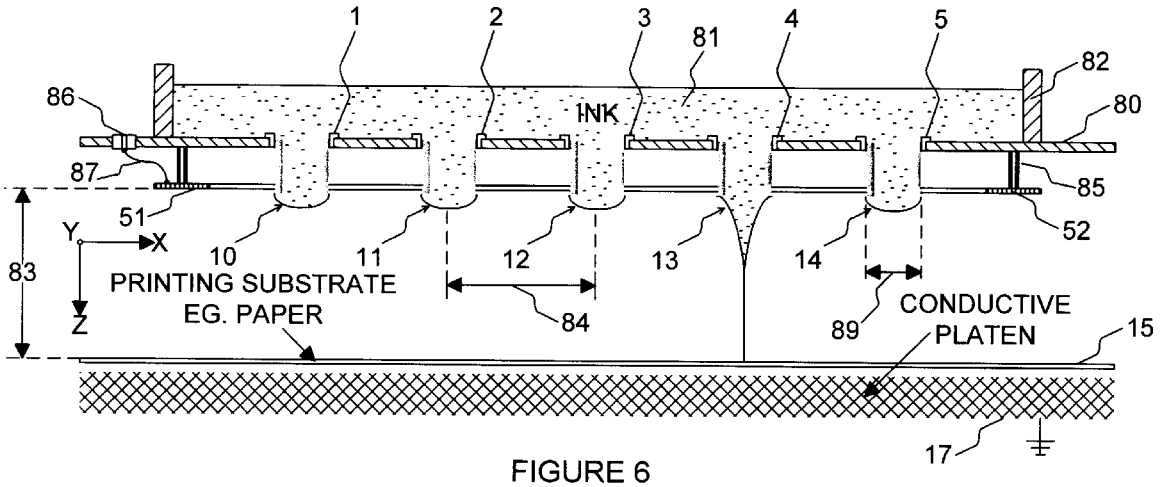
FIG. 6 is a section view of the printhead of FIG. 5 that is taken along the line 6—6 of FIG. 5.

FIG. 5 is a top view of printhead 20 that is taken in the X-Y plane of FIGS. 3 and 4. FIG. 5 shows a nonlimiting construction of a printhead 20 having utility relative to the present invention. FIG. 6 is a section view of the printhead of FIG. 5 that is taken along the line 6—6 of FIG. 5.

The FIG. 5, 6 printhead provides a construction and arrangement whereby short tubular nozzles 10–14 are formed so as to protrude downward from a printed circuit board 80 toward paper 15 which overlies grounded metal plate 17. A supply of printing ink 81 is contained in a reservoir 82. Tubular nozzles 10–14 extend generally parallel to each other, and normal to the plane of paper 15 and plate 17. An exemplary spacing 83 of the nozzles from paper 15 is about 1 mm. An exemplary center-to-center spacing 84 of adjacent nozzles is about 1 mm. An exemplary inner diameter 88 in FIG. 4 of nozzles 10–14 is about 150 micrometer, and an exemplary outer diameter 89 in FIG. 6 of nozzles 10–14 is about 200 micrometer.

As seen in FIGS. 5, 6, FCE 51, 52 is provided as a continuous conductive path that is carried by a nonconductive support member 85 so as to encircle all of the nozzles 10–14. Conductive path 51, 52 is connected to an electrical conductor 86 by way of conductor 87 (FIG. 6), whereas nozzles 10–14 are connected to electrical conductors identified as 1–5.

Figure 7:
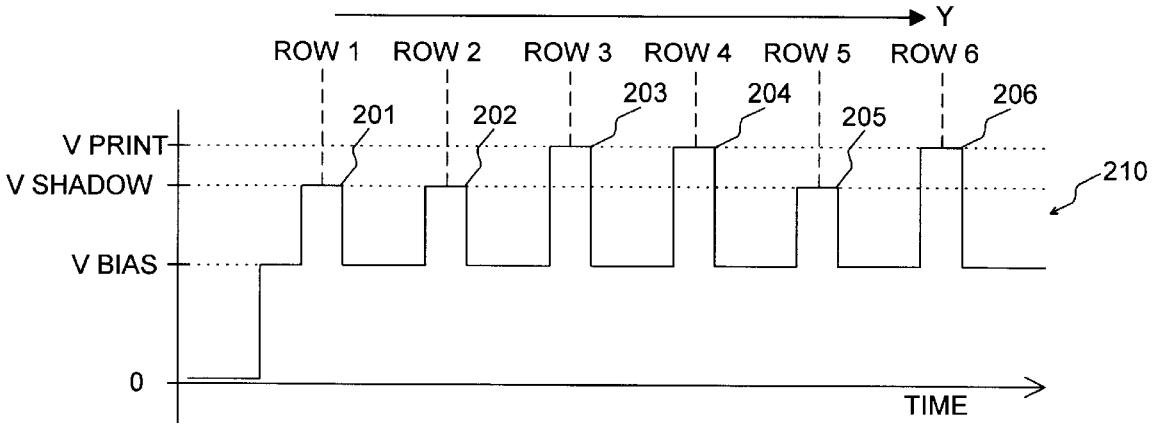
FIG. 7 shows an example of the voltage that is applied to one of the nozzles of FIGS. 3–6 in order to print a six-pixel, Y-direction column on paper, this example column containing two blank pixels, followed by two printed pixels, followed by one blank pixel, followed by one printed pixel.

FIG. 7 is an example of the voltage waveform 210 that is applied to one of the nozzles of FIGS. 3–6 in order to print a six-pixel, Y-direction column on paper 15, this example print column containing two blank pixels, followed by two printed pixels, followed by one blank pixel, followed by one printed pixel.

As will be appreciated by those of skill in the art, above described nozzles 10–14 print spaced and parallel X-direction rows of pixels on the paper. The Y-direction spacing of these rows depends on the frequency of print pulses and the Y-direction paper speed. The X-direction spacing of each of the nozzles 10–14 defines the location of a Y-direction column of pixels on paper 15, as paper 15 moves in the Y-direction under stationary nozzles 10–14.

Waveform 210 of FIG. 7 includes six voltage pulses that define the printing, or non-printing, of a pixel column comprising pixel row 1, pixel row 2, pixel row 3, pixel row 4, pixel row 5, and pixel row 6. As can be seen in FIG. 7, at all times other than a print time (i.e., as paper 15 moves between print rows), the voltage that is applied to a nozzle 10–14 is of the magnitude Vb. When paper 15 moves to a print row position under printhead 20, each of the nozzles 10–14 receives either a shadow voltage pulse Vs, or a print voltage pulse Vp.

For the assumed nozzle of FIG. 7, when paper 15 reaches a position such that printhead 20 becomes operable to print row 1, this particular nozzle receives the voltage pulse 201 which causes an ink meniscus to form, but does not cause an ink filament to move from the nozzle to paper 15. Later, when paper 15 moves to its row 2 position, this particular nozzle again is provided with the no-print shadow voltage pulse 202. As paper 15 continues to move through print rows 3, 4, 5 and 6, this particular nozzle receives the respective print voltage pulses 203 and 204, then no-print pulse 205, and then print pulse 206.

This application of either a shadow pulse Vs or a print pulse Vp to the nozzles of printhead 20 can be controlled, as is well known, by a print-page data source, wherein every pixel in a page that is not to be printed is represented by a binary "0", and wherein every pixel in a page that is to be printed is represented by a binary "1".

In the embodiment of the invention shown in FIG. 4, wherein each nozzle is controlled to not only print a pixel, but to also print a pixel dot of variable ink density by varying the time duration of the print pulse Vp, the print-page data source may comprise a multi-bit binary number for each pixel. When this binary number comprises all zeros, a no-print or Vs pulse is provided to the related nozzle. When this binary number contains at least one "1", a print pulse Vp is provided to the related nozzle, and the time duration of this print pulse Vp is directly related to the binary value of the multi-bit binary number.

Figure 8:
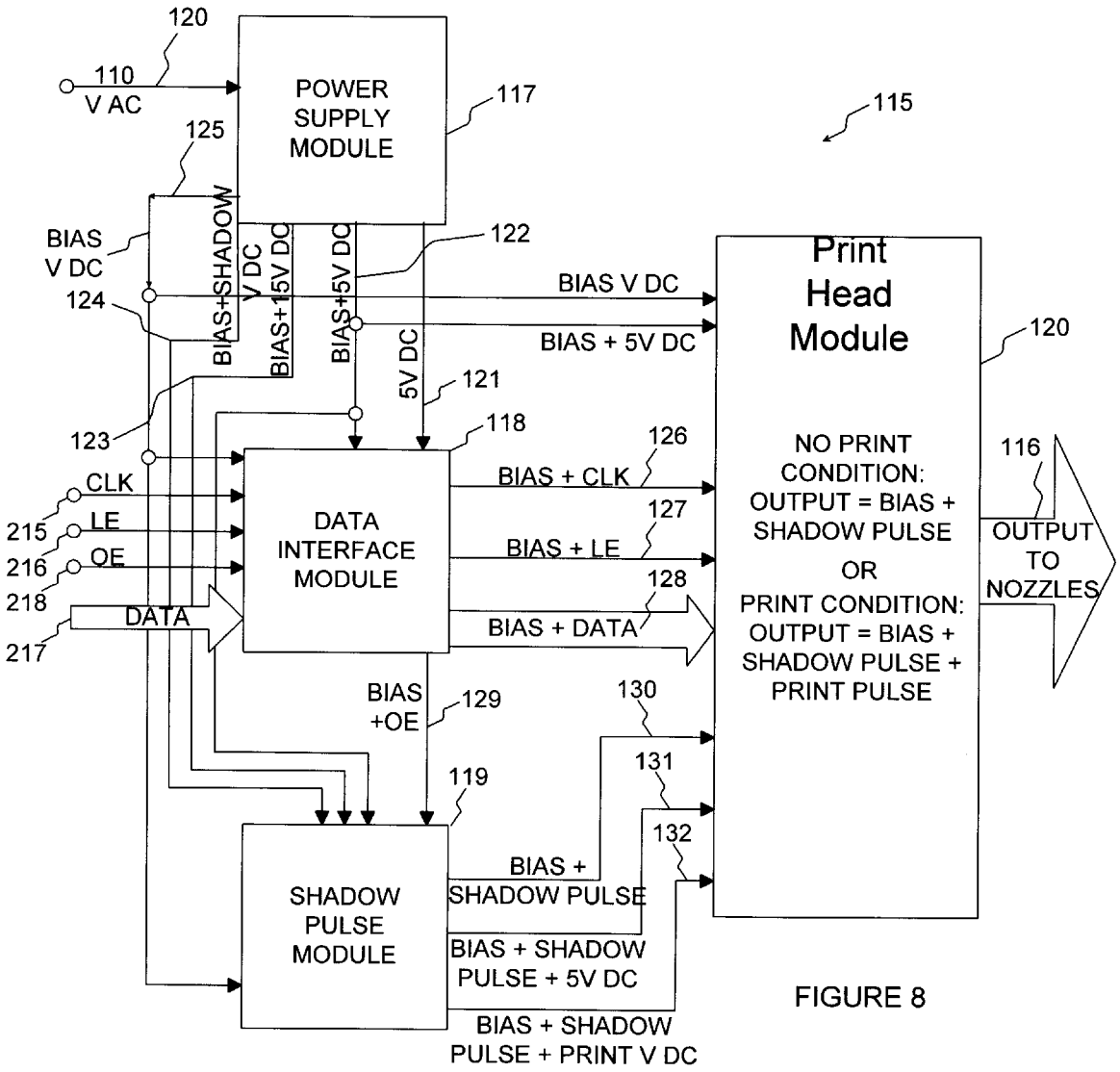
FIG. 8 is a block diagram showing a printhead electronic network in accordance with the invention, this electronic network being constructed and arranged to drive a 64-nozzle printhead of the type generally shown in FIGS. 5 and 6, and this electronic network including a power supply module, a data interface module, a shadow pulse module, and a printhead module.

FIG. 8 is a block diagram showing a printhead electronic network 115 in accordance with the invention. Network 115 is constructed and arranged to provide an output that operates to drive an exemplary 64-nozzle printhead of the type that is generally shown in FIGS. 5 and 6. The details of construction and arrangement of such a printhead may take a variety of forms, thus the printhead per se will not be discussed in detail relative to a description of electronic network 115. Electronic network 115 includes a power supply module 117, a data interface module 118, a shadow pulse module 119, and a printhead module 120.

In the following description, it will be assumed, without limitation thereto, that the magnitude of Vb or bias VDC is 1,000 VDC, that the magnitude of shadow pulse Vs is 500 VDC, and that the magnitude of print pulse Vp is 150 VDC (see FIG. 3 for example ranges of these three voltages).

The electronic design of network 115 is based upon a concept that provides a unique referencing of all voltages that are applied to the printhead's nozzles, the printhead's field-compensation-electrodes, and the print substrate's ground plane member, relative to zero volts; i.e., relative to ground potential level 17 of FIG. 3.

As can be seen from FIG. 8, power supply module 117 is powered by a 3-wire AC input 120; for example, 110 VAC. The five outputs of power supply module 117 comprise, "5 VDC" output 121, "bias VDC+5 VDC" output 122, "bias VDC+15 VDC" output 123, "bias VDC+shadow VDC" output 124, and "bias VDC" output 125.

With reference to FIG. 3, typical and nonlimiting values of the bias VDC voltage and the shadow VDC may be 1,000 VDC and 500 VDC, respectively. In this case, the magnitude of output 122 is 1,005 VDC, the magnitude of output 123 is 1,015 VDC, the magnitude of output 124 is 1,500 VDC, and the magnitude of output 125 is 1,000 VDC.

A feature of printhead electronic network 115, in accordance with the invention, is that power supply module 117 provides five output voltages, outputs 121 and 125 of which are respectively of the example magnitude 5 VDC and 1,000 VDC, relative to ground potential. The other three outputs 122, 123, and 124 of power supply module 117 are of the respectively different magnitudes 5 VDC, 15 VDC and 500 VDC (500 VDC being the assumed magnitude of shadow VDC), wherein these three different magnitudes are all carried by the assumed 1,000 VDC bias pedestal or carrier.

As shown in FIG. 8, the "5 VDC" output 121, the "bias VDC+5 VDC" output 122, and the "bias VDC" output 125 of power supply module 117 are connected to provide three different DC voltages to data interface module 118.

Data interface module 118 receives as signal inputs, the four following logic-level control signals; clock (clk) 215, latch-enable (LE) 216, print data 218, and output-enable (OE) 218. All four of these signals are logic-level signals. In this case, these signals have an example magnitude of 5 VDC. The frequency of clock signal 215 is related to the data rate of print data signal 218, as is well known by those of skill in the art. Output-enable signal 218 is of a constant 5 VDC so long as print substrate 15 is available for printing. For example, when pixel rows are being printed in the narrow direction on 8½×11 inch paper, then a page comprises about 3,300 pixel rows for 300 dot per inch printing. So long as print substrate 15 is moving within this 3,300 row area, the signal OE is pulsing; i.e., is of the magnitude 5 VDC. Latch-enable signal 216 pulses to provide logic-level 5 VDC whenever print substrate 15 is in a position such that a pixel row can be printed thereon.

Data interface module 118 operates to generate four outputs; namely, "bias VDC+clock" output 126, "bias VDC+latch-enable" output 127, "bias VDC+data" output 128, and "bias VDC+output-enable" output 129.

As mentioned, the latch-enable portion of above-described output 127 could also be called "print-enable", since this signal operates to apply print/no-print pulses to the printhead's nozzles in synchronism with the physical position of moving substrate 15. That is, latch-enable/print-enable signals 216,127 of FIG. 8 operate to determine the time at which print/no-print pulse 201–206 of FIG. 7 are sequentially applied to the printhead nozzles, as above described relative to FIG. 7.

As shown in FIG. 8, bias "VDC+5 VDC" output 122, "bias VDC+15 VDC" output 123, "bias VDC+shadow VDC" output 124, and "bias VDC" output 125 of power supply module 117 are connected to provide four different DC voltage inputs to shadow pulse module 119. "Bias VDC+OE" output 129 of data interface module 118 operates to enable shadow pulse module 119 so long as print substrate 15 is in a position to be printed, as above described.

Shadow pulse module 119 operates to generate three outputs; namely, "bias VDC+shadow pulse" output 130, "bias VDC+5 VDC +shadow pulse" output 131, and "bias VDC+print VDC+shadow pulse" output 132. As an example only, the magnitude of print VDC may be about 150 VDC, as shown in FIG. 3.

Using the assumed magnitude of 500 VDC for shadow pulses 111,112 of FIG. 3, outputs 130,131 and 132 all vary in the cyclic manner, and at a rate that is determined by the rate at which output-enable signal 218 is generated, between peaks and valleys that are separated by this 500 VDC swing.

Note that in this manner, the cyclic 500 VDC shadow pulse signal that is generated by shadow pulse module 119 is carried on top of DC voltages having the following three different DC magnitudes; 1,000 VDC (bias VDC), 1,005 VDC (bias VDC+5 VDC), and 1,150 VDC (bias VDC+print VDC).

Printhead module 120 receives eight inputs; namely, (1) the "bias VDC" output 125 of power supply module 117, (2) the "bias VDC+5 VDC" output 122 of power supply module 117, (3) the "bias VDC+clk" output 126 of data interface module 118, (4) the "bias VDC+LE" output 127 of data interface module 118, (5) the "bias VDC+data" output 128 of data interface module 118, (6) the "bias VDC+shadow pulse" output 130 of shadow pulse module 119, (7) the "bias VDC+5 VDC+shadow pulse" output 131 of shadow pulse module 119, and (8) the "bias VDC+print VDC+shadow pulse" output 132 of shadow pulse module 119.

Note that three of the above-mentioned 5-VDC logic-level printhead controlling input signals that are provided to printhead module 120 by data interface module 118 (i.e., clock 126, latch-enable 127, and print data 128), are all carried on top of the relatively high magnitude of "bias VDC", here assumed to be 1,000 VDC.

From these eight inputs, printhead module 120 operates to provide a multi-channel output 116 to the printhead. For each nozzle of the printhead, output 116 comprises either a no-print-condition output, or a print-condition output. With reference to FIG. 3, a no-print-condition output 116 of printhead module 120 is shown at 111 and 112 where the voltage that is applied to each no-print nozzle equals "bias VDC+shadow pulse" (for example 1,000 VDC+500 VDC), whereas a print-condition output of printhead module 120 is shown at 100, 113 and 114 where the voltage that is applied to each print nozzle equals "bias VDC+shadow pulse +print pulse" (for example, 1,000 VDC+500 VDC+150 VDC).

In addition, and for the printhead shown in FIGS. 5 and 6, a voltage of the no-print magnitude is also applied to FCE 51,52.

Figure 9:
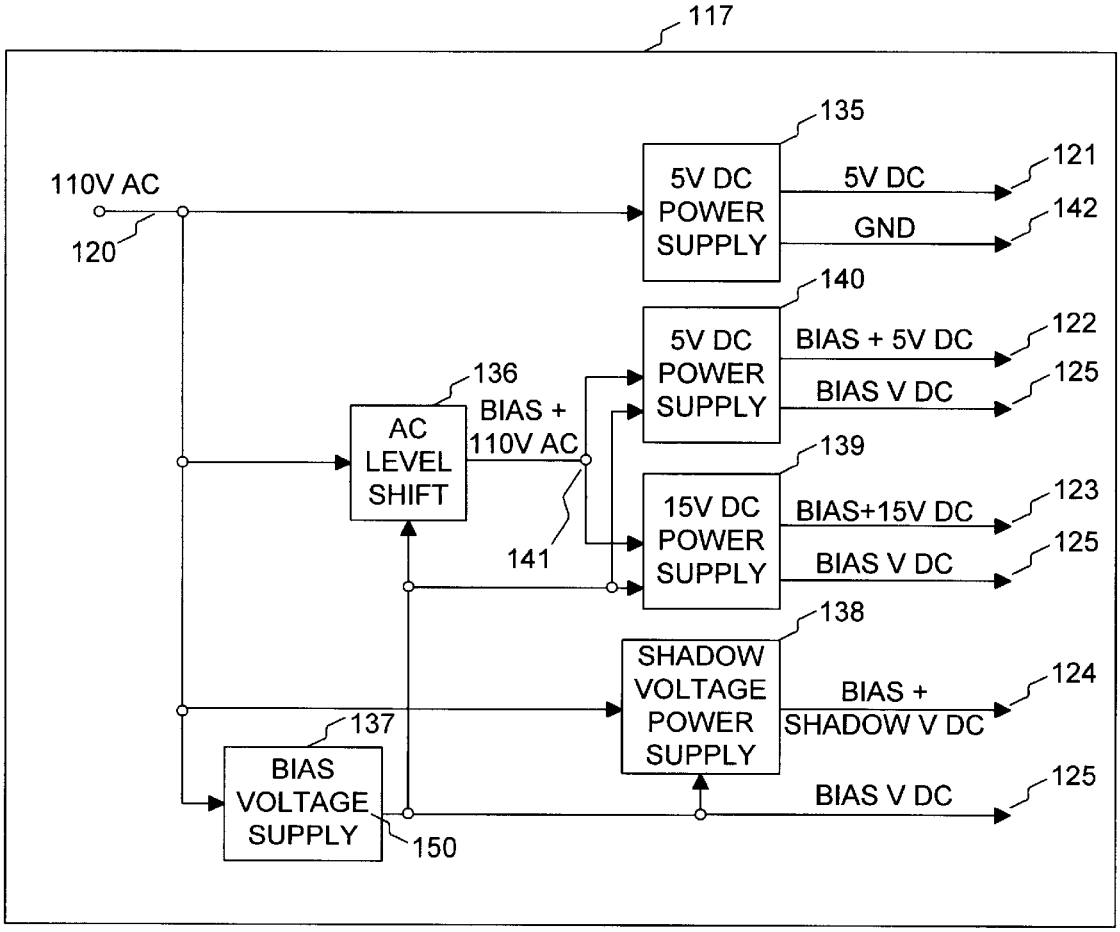
FIG. 9 shows details of the power supply module of FIG. 8.

FIG. 9 shows details of power supply module 117 shown in FIG. 8. As can be seen in this figure, AC input voltage 120 provides operating power to a 5 VDC power supply 135, an AC level shifting network 136, a bias voltage supply 137, and a shadow pulse power supply 138.

Ground output 142 of 5 VDC power supply 135 is connected to all ground reference points of the electronic system, including AC ground, chassis ground and backing plate 17 of FIG. 3.

Shadow voltage power supply 138 operates to provide the above-described "bias VDC+shadow VDC" output 124, this output being generated by combining its own internally generated shadow VDC with bias VDC output 150 of bias voltage supply 137.

15 VDC power supply 139 operates to provide the above-described "bias VDC+15 VDC" output 123, this output being generated by combining its own internally generated 15 VDC with bias VDC output 150 of bias voltage supply 137. Note that 15 VDC power supply 139 receives its operating power from the "bias VDC+110" VAC output 141 of AC level shifter 136.

5 VDC power supply 140 operates to provide the above-described "bias VDC+5 VDC" output 122, this output being generated by combining its own internally generated 5 VDC with bias VDC output 150 of bias voltage supply 137. Again, note that 5 VDC power supply 140 receives its operating power from the "bias VDC+110 VAC" output 141 of AC level shifter 136.

A feature of power supply module 117 is that its two outputs 121 and 125 are of the respective magnitudes 5 VDC and 1,000 VDC (bias) relative to ground, and that its three outputs 122, 123, and 124 are of the respective relative magnitudes 5 VDC, 15 VDC, and 500 VDC (shadow VDC), as measured relative to the bias VDC carrier of 1,000 VDC.

Figure 10:
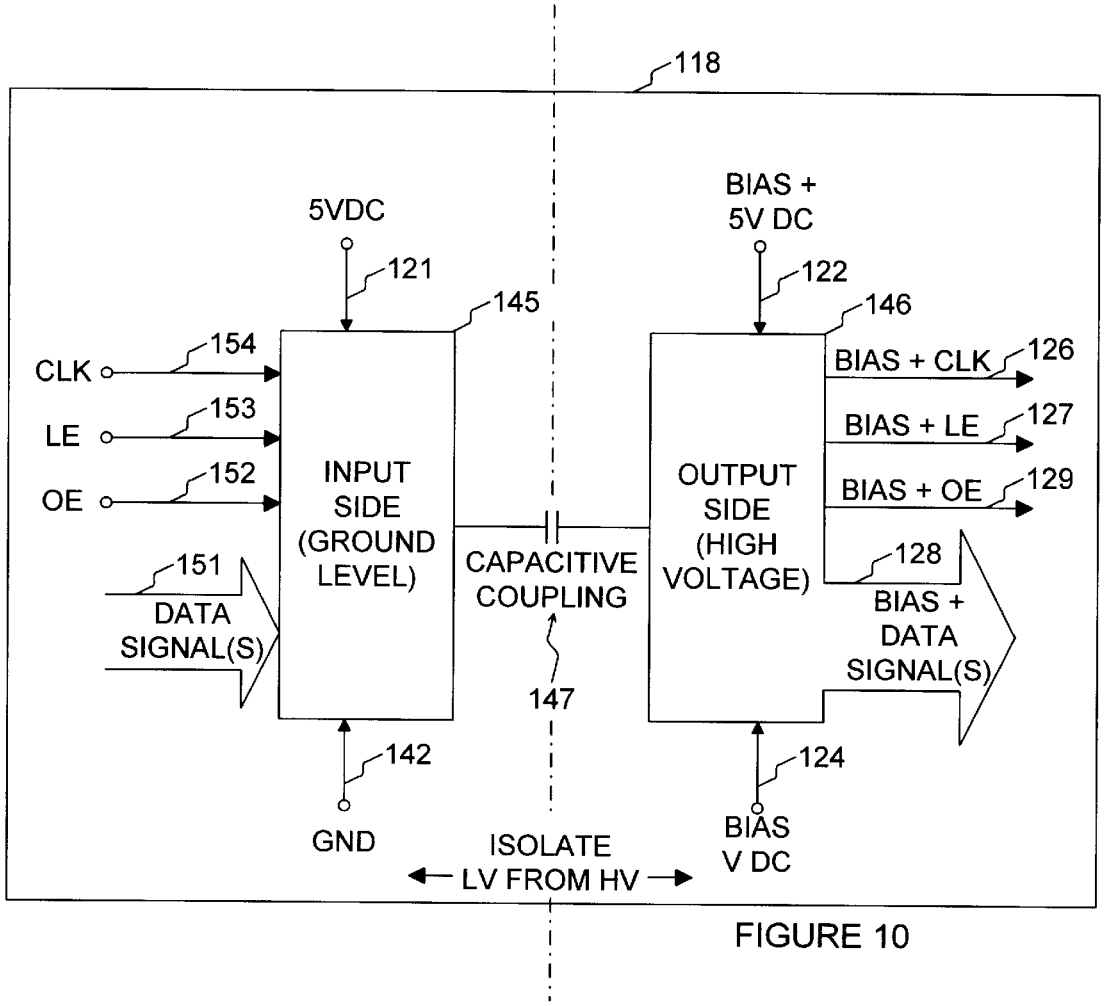
FIG. 10 shows details of the data interface module of FIG. 8.
Figure 11:
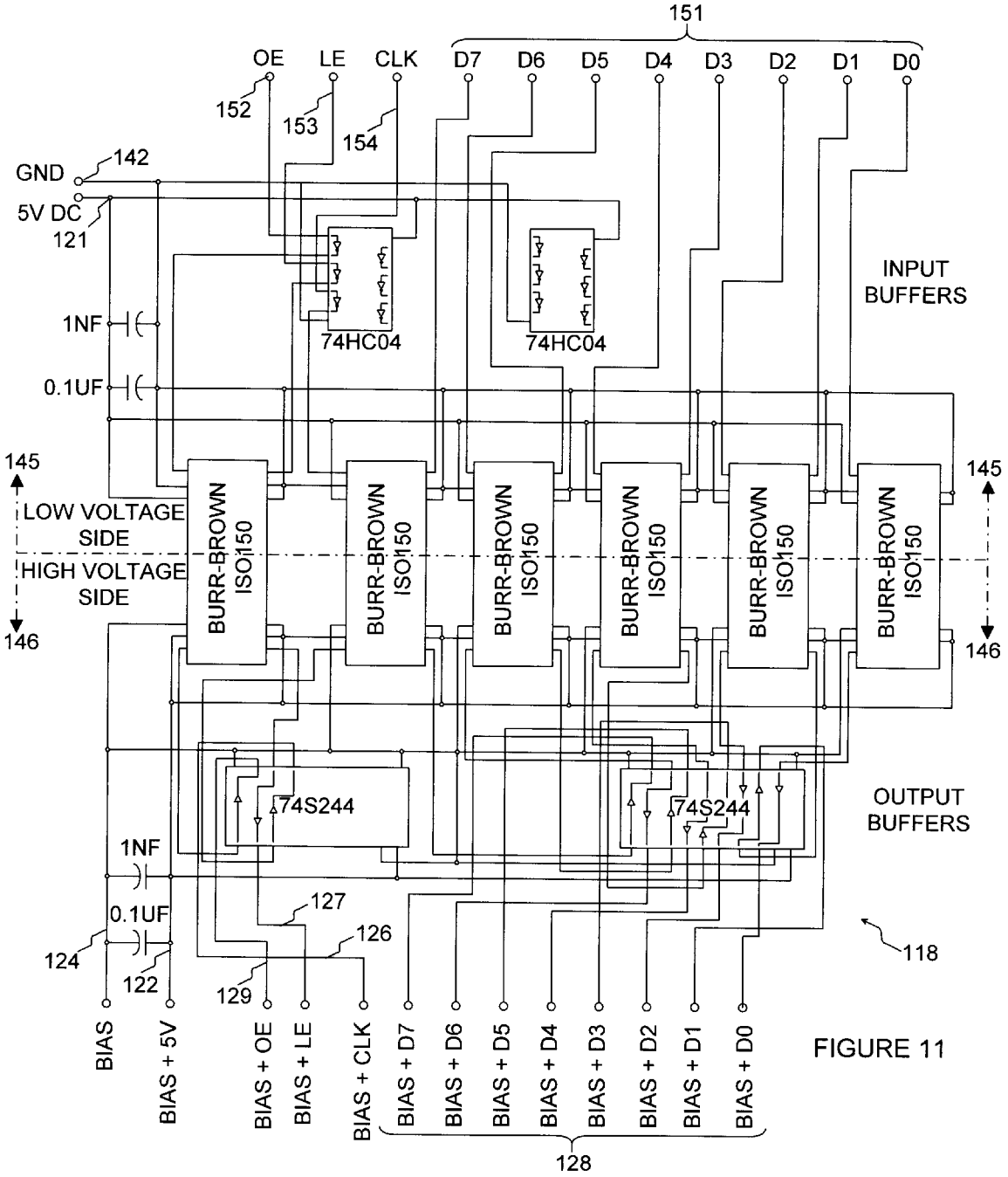
FIG. 11 shows the data interface module of FIG. 10 in yet greater detail.

FIG. 10 shows data interface module 118 of FIG. 8 in greater detail, and FIG. 11 shows this data interface module 118 in even greater detail.

Data interface module 118 comprises a low voltage, or ground level input side 145, and a high voltage or 1,000 VDC shifted output side 146. The circuits within low voltage and high voltage sides 145,146 communicate through, and are isolated and separated by, capacitive coupling means 147. Input side 145 is powered by 5 VDC input 121, this 5 volt input voltage 121 being referenced to ground potential at 142. Output side 146 is also powered by 5 VDC, but in this case output side 146 is powered by "bias VDC+5 VDC" input 122, this high 1,005 VDC voltage being referenced to 1,000 VDC (i.e., to bias VDC) at 124.

As will be appreciated, other forms of circuit isolation, i.e., other than capacitive isolation 147, can be used to isolate low and high voltage circuits 145,146, an example being optical signal-coupling/voltage-isolation.

FIGS. 10 and 11 also show four control signals 151,152, 153,154 that operate to supply print data, output-enable data, latch-enable data, and clock data, to control the printing of a page-image onto print substrate 15 of FIG. 3. More specifically, data interface module 118 receives an 8-bit data signal on bus 151, the eight bits being identified as d0–d7 in FIG. 11. In addition, an output-enable signal is received on conductor 152, a latch-enable signal is received on conductor 153, and a clock signal is received on conductor 154. The specific technique and means used to print a pixel-page-map onto substrate 15 is not material to this invention, and will not be described in detail herein.

Data interface module 118 operates to provide an 8-bit print data output 128, comprising 8 binary data signals that are superimposed upon, or are carried by, the bias VDC level of 1,000 VDC. In FIG. 11, this 8-bit output 128 is identified by bits d0–d7.

In addition, interface module 118 operates to provide a logic-level clock output signal 126, a logic-level latch-enable output signal 127, and a logic-level output enable signal 129, all three of which are superimposed upon, or are carried by, the bias VDC level of 1,000 volts DC.

A feature of data interface module 118 is that all four of its ground-potential-referenced printhead controlling input signals clk 154, latch-enable 153, output-enable 152, and print data 151, enter module 118 at potentials that are referenced to ground potential, whereas module 118 operates such that its four corresponding logic-level output signals, clk 126, latch-enable 127, output-enable 129 and print data 128, are all carried on the 1,000 VDC pedestal of bias VDC.

Figure 12:
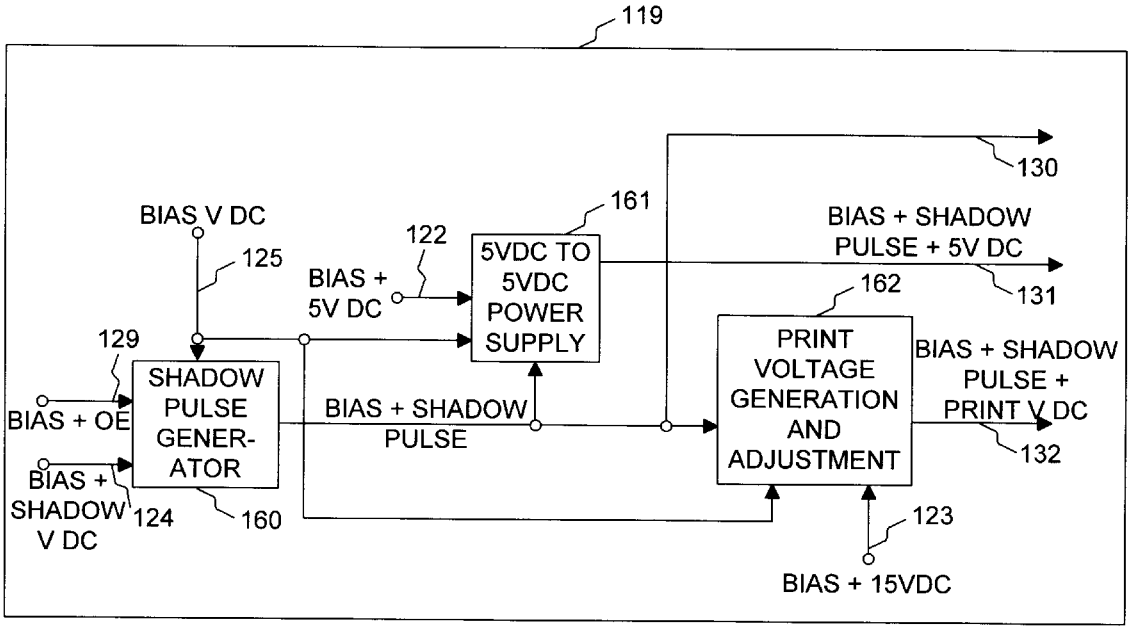
FIG. 12 shows details of the shadow pulse module of FIG. 8.

FIG. 12 shows details of shadow pulse module 119 shown in FIG. 8. A shadow pulse generator 160 receives the three inputs "bias VDC" 125, "bias VDC+OE" 129, and "bias VDC+shadow VDC" 124. Shadow pulse generator 160 operates upon these three inputs to provide bias VDC+shadow pulse output 130.

Operating power is supplied to shadow pulse module 119 so long as output-enable signal 129 is pulsed; i.e., so long as signal 218 of FIG. 8 is of a pulsed logic-level 5 VDC, thereby causing signal 129 to be of the magnitude from 1,000 VDC to 1,005 VDC. This pulsed operating voltage of 1,005 VDC is referenced to 1,000 VDC at conductor 125, thus providing 5 VDC pulsed operating voltage to shadow pulse generator 160.

A "5 VDC to 5 VDC" power supply 161 receives 5 VDC operating power from the two inputs "bias VDC+5 VDC" 122 and "bias VDC" 125, and receives control input from the "bias VDC+shadow pulse" output 130 of shadow pulse generator 160. Power supply 161 operates to generate output 131 comprising "bias VDC+shadow pulse+5 VDC".

A "print voltage generation and adjustment" network 162 receives 15 VDC operating power from the two inputs "bias VDC+15" VDC 123, "bias VDC" 125, and receives control input by way of the "bias VDC+shadow pulse" output 130 of shadow pulse generator 160. Network 162 operates to generate output 132 comprising "bias VDC+shadow pulse+ print VDC".

Figure 13:
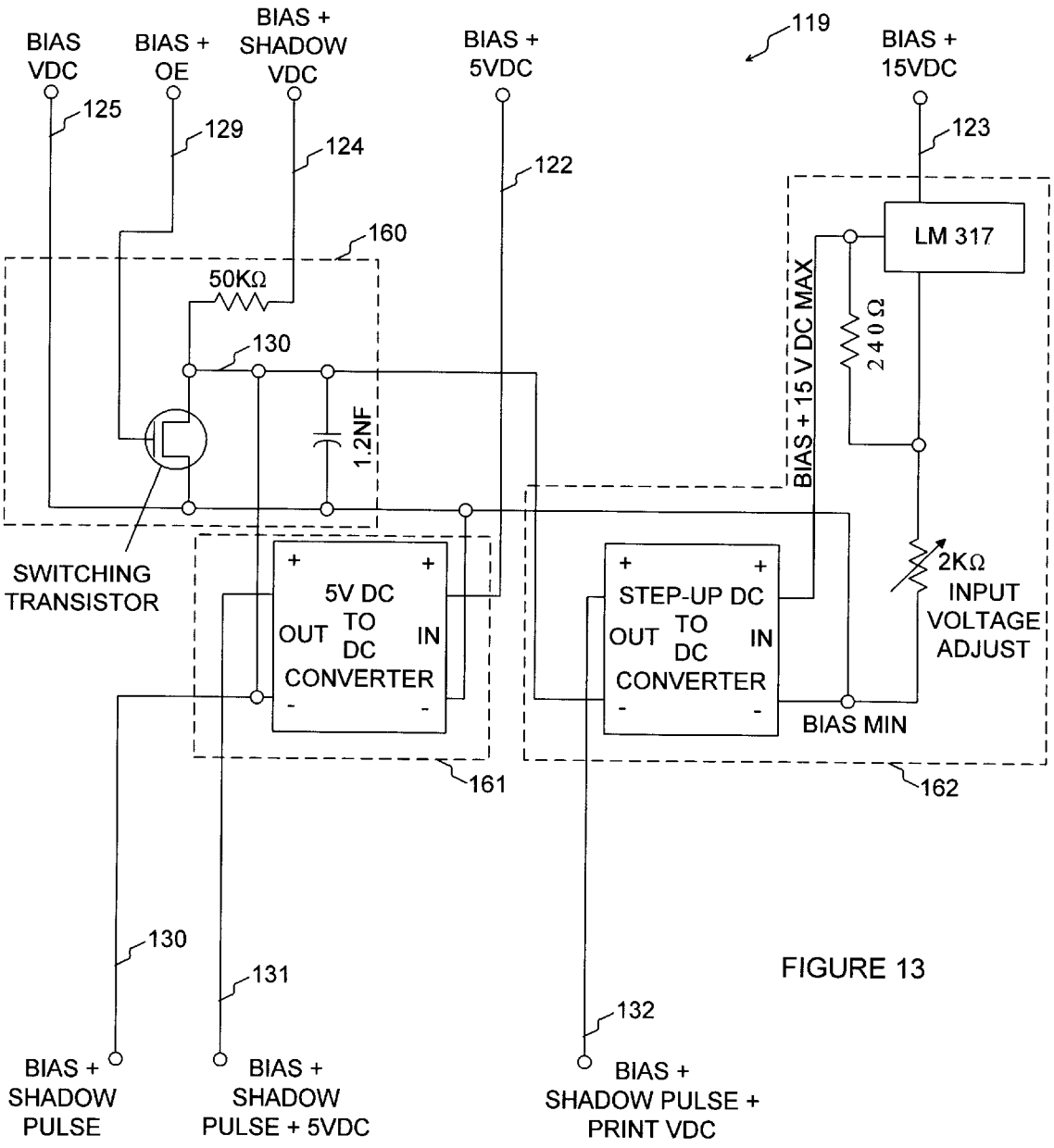
FIG. 13 shows details of the shadow pulse module of FIG. 8 in even greater detail.

FIG. 13 shows details of shadow pulse module 119 in even greater detail.

Note that "bias+shadow pulse" output 130 is equivalent in magnitude to no-print pulses 111 and 112 of FIG. 3, and that "bias+shadow pulse+print VDC" output 132 is equivalent in magnitude to print pulses 100,113,114 of FIG. 3.

Output 132 that is of a magnitude "bias+shadow pulse+5 VDC" comprises a 5 VDC logic-level control signal voltage supply when signal 132 is referenced to the magnitude "bias+shadow pulse".

Figure 14:
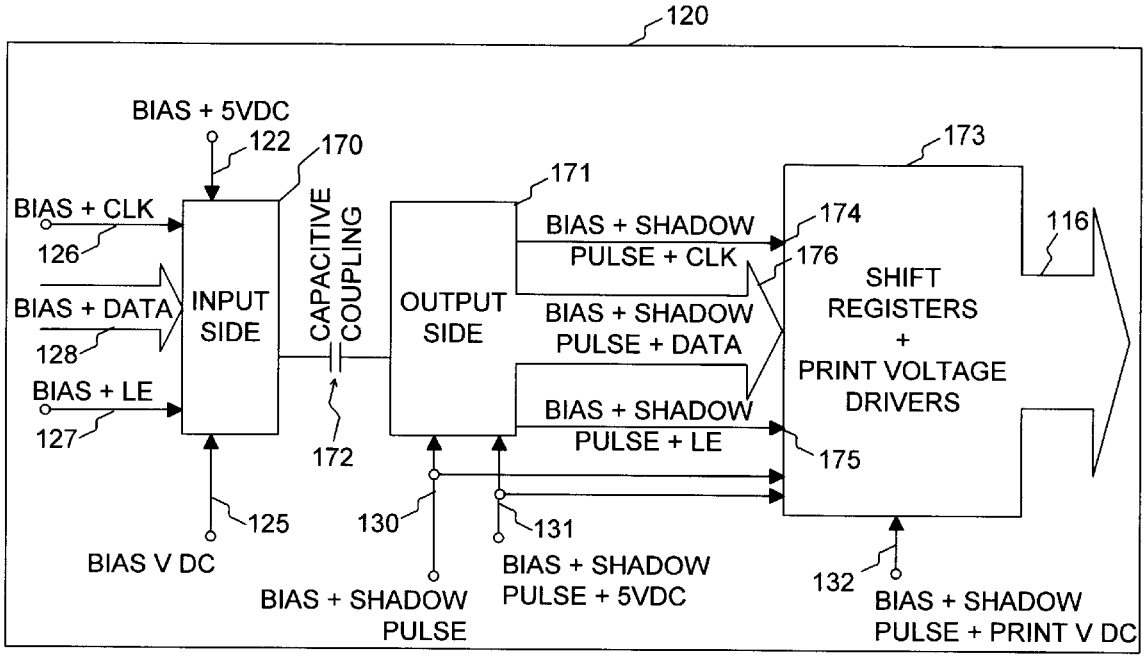
FIG. 14 shows details of the printhead module of FIG. 8.
Figure 15A:
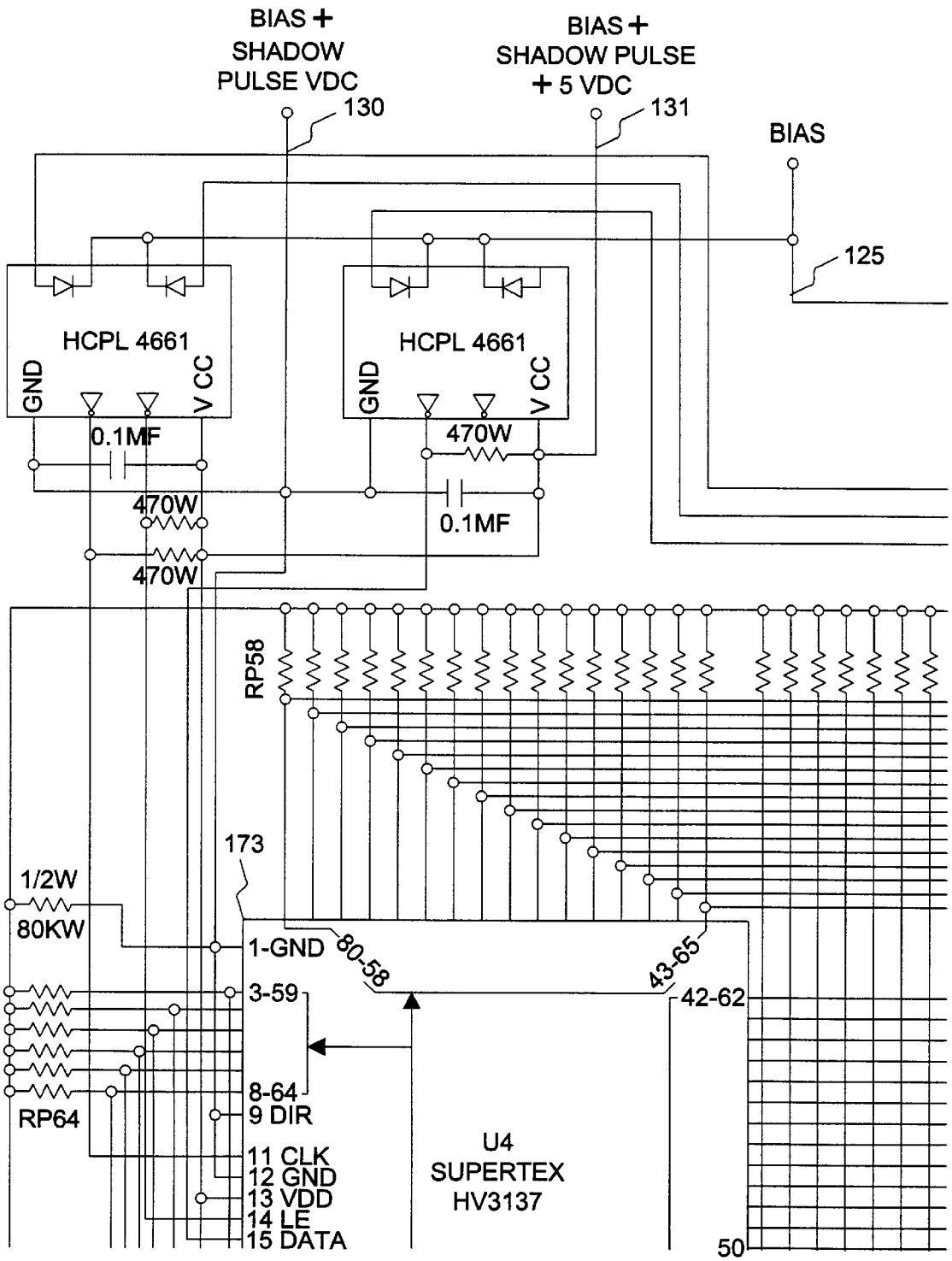
FIG. 15 shows the printhead module of FIG. 14 in yet greater detail.
Figure 15B:
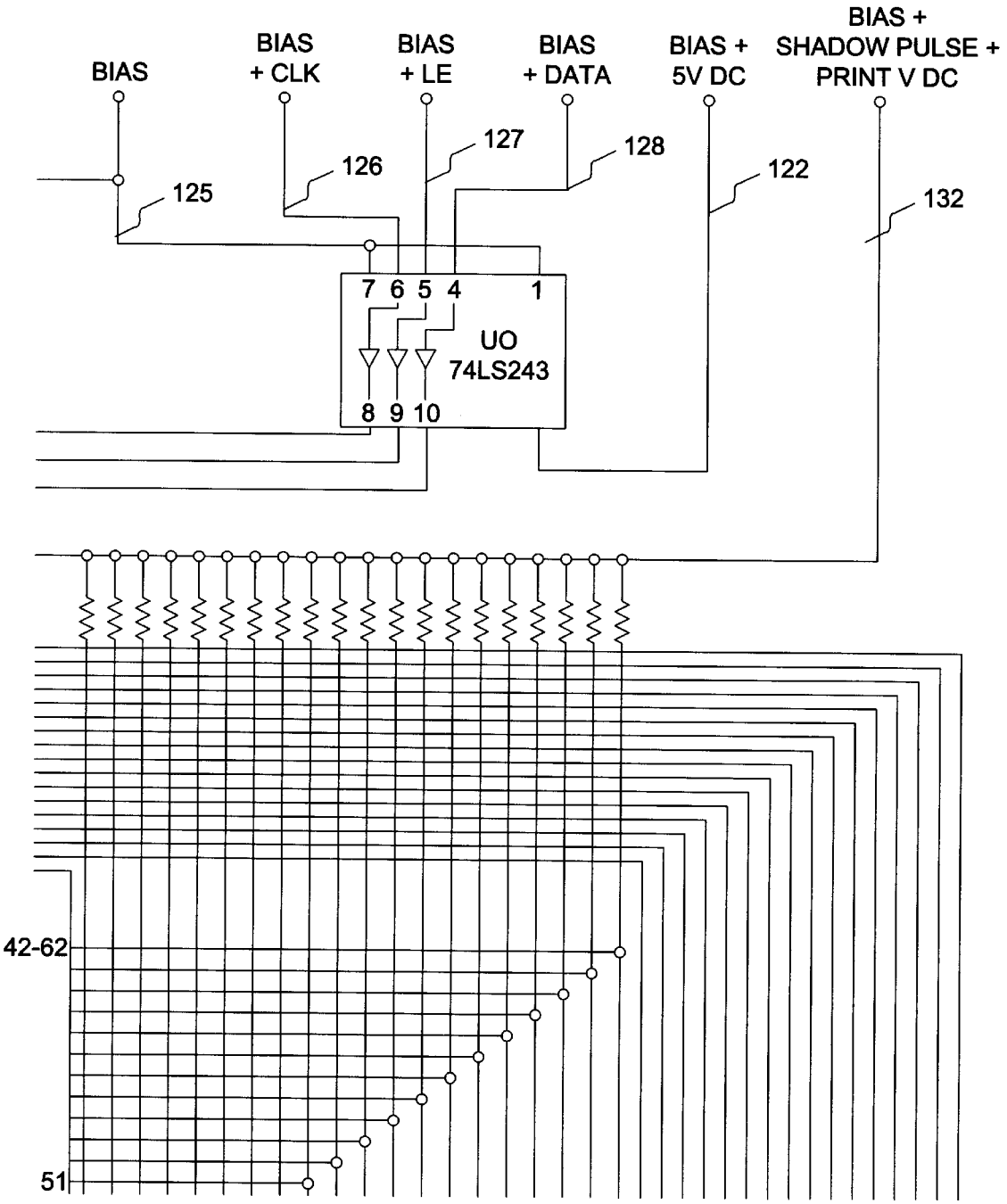
Figure 15C:
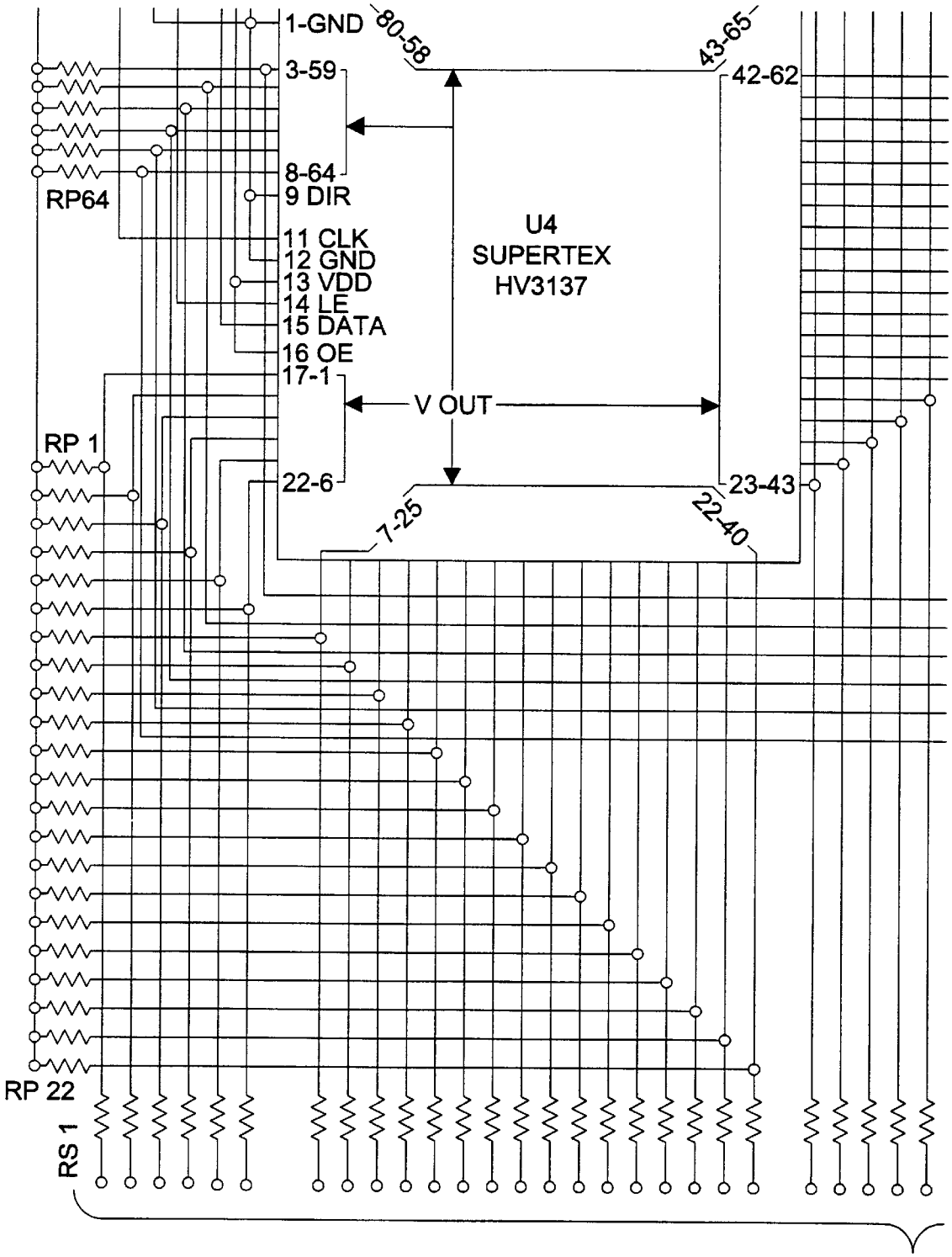
Figure 15D:
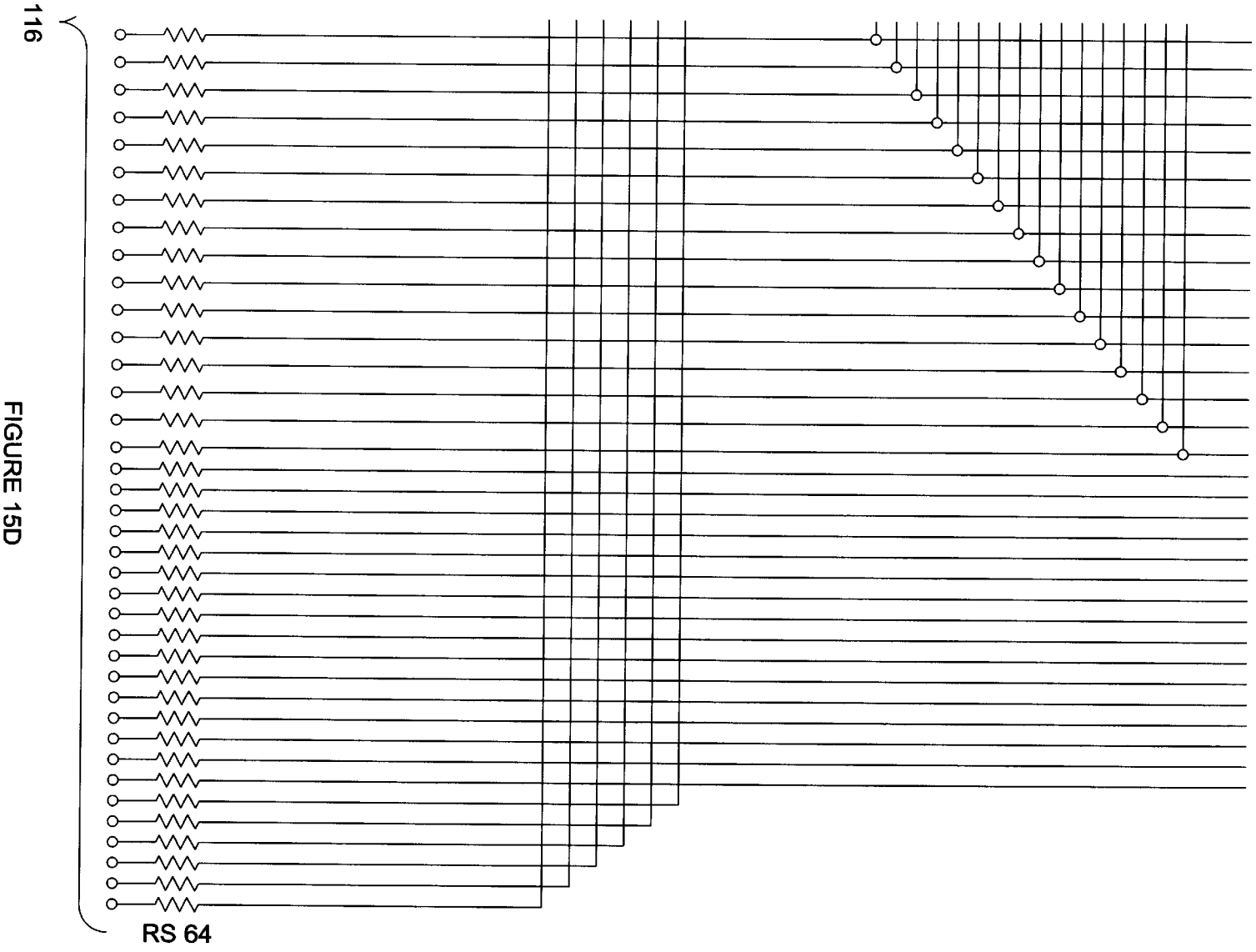

FIG. 14 shows details of printhead module 120 of FIG. 8. Printhead module 120 is provided with an input side 170 that is referenced to 1,000 VDC (bias VDC), and with an output side 171 that is referenced to 1,500 VDC (bias+shadow pulse). These two sides 170,171 are signal coupled and voltage isolated by an isolation coupling network; for example, capacitive coupling network 172.

Input side 170 receives 5 VDC operating power from conductor 122, this operating power being of a magnitude "bias VDC+5 VDC" relative to ground potential. However, input side 170 does not operate with reference to ground potential. Rather, input side 170 operates with reference to the potential of line 125; i.e., "bias VDC".

Likewise, output side 171 receives 5 VDC operating power from conductor 131, this operating power being of the higher magnitude "bias VDC+shadow pulse+5 VDC" relative to ground potential. However, output side 171 does not operate with reference to ground potential. Rather, output side 171 operates with reference to the potential of line 130; i.e., "bias VDC+shadow pulse".

Input side 170 and output side 171 operate upon the three input signals, clock 126, data 128, and latch-enable 127. Note that all three of these input signals are carried by the "bias VDC" voltage level of 1,000 VDC.

In response to these three inputs, output side 171 produces the three signal outputs, clock 174, latch-enable 175, and data 176. Note that all three of these output signals are carried by the "bias VDC+shadow pulse" voltage level which is pulsed between 1,000 VDC and 1,500 VDC.

A network of shift registers and print voltage drivers 173 receives 5 VDC operating power from "bias+shadow pulse+5 VDC" conductor 131, as this voltage magnitude is referenced to the magnitude "bias+shadow pulse" that is provided by conductor 130.

Network 173 operates upon the three signal inputs 174, 175,176, and generates output 116; i.e., the output that is provided to an exemplary 64-nozzle printhead. Output 116 comprising a no-print-voltage of the magnitude "bias VDC+shadow pulse" for each non-printing nozzle, and for the printhead's FCE (see 201,202,205 of FIG. 7), and a print-voltage of the magnitude "bias VDC+shadow pulse+print pulse" for each of the printing nozzles (see 203,204,206 of FIG. 7).

A feature of printhead module 120 is that its three input printhead controlling signals, clk 126, print data 128, and latch-enable 127 all enter input side 170 on top of a 1,000 VDC pedestal (bias), and the corresponding four output signals 174, 175 and 176 leave output side 171 on top of a pulsed 1,000 to 1,500 VDC pedestal (bias VDC+shadow pulse).

As will be apparent to those of skill in the art, other combinations of voltages can be applied to grounded platen 17, to the printhead nozzles, and to field compensation electrodes 51,52 so as to provide the desired electrostatic voltage differences that are above defined. However, it is usually desirable from the safety standpoint to maintain platen 17 at ground potential, and to limit the potential that is applied to the circuitry of FIG. 8 in the general fashion that is described herein. As shown in FIG. 7, this can be accomplished by using the DC bias voltage Vb as a carrier, or as the ground level, for shadow pulse Vs and print pulse Vp.

The simplest embodiment of a printhead driver uses two transistors, or two drive circuits, per print nozzle, with one transistor/drive-circuit being turned-on by a no-print-logical-level of 0, to thereby provide shadow pulse Vs to the print nozzle, and with the other transistor/drive-circuit being turned-on by a print-logical-level of 1 to thereby provide the print pulse Vp to the print nozzle. Since electrostatic fields require very little current flow to maintain the fields, an extension of the above is to provide a single transistor, or a small number of transistors, to drive all no-print nozzles to the magnitude of Vs, and to provide one additional transistor per nozzle to drive each print nozzle to the magnitude of Vp. This results in an improvement that reduces the number of nozzle drive circuits from the number 2N to the number N+1, where N is the number of nozzles in the printhead.

The above-described printhead electronic network 115 of FIG. 8 takes advantage of the voltage differential that exists between the magnitude of shadow pulse Vs, and the magnitude of print pulse Vp (here assumed to be 500 VDC and 650 VDC, respectively) in order to limit the magnitude of the voltages that must be switched, thus reducing circuit power requirements, increasing circuit packaging density, and decreasing circuit cost.

In order to switch only a relatively low voltage differential, bias VDC (1,000 VDC) is a carrier for shadow pulse Vs (500 VDC), and the shadow pulse is a carrier for the differential between (150 VDC) shadow pulse Vs and print pulse Vp.

Figure 16:
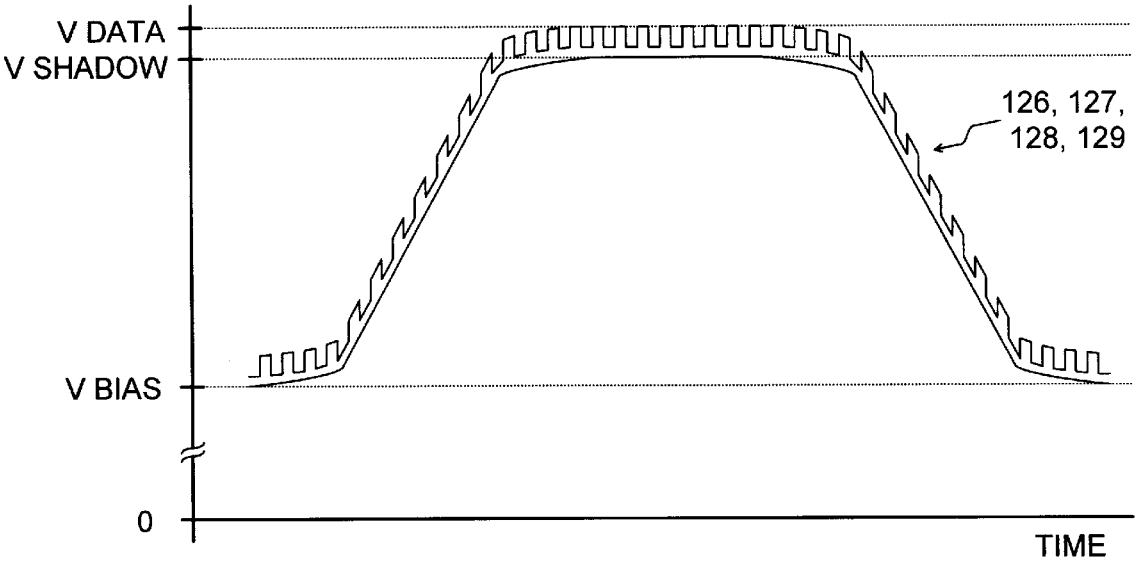
FIG. 16 shows the manner in which the bias VDC (Vb) and shadow VDC (Vs) are carriers for the DC voltage supplies, as well as the print data 128, the output-enable control 129, the latch-enable control 127, and the clock control 126 of FIG. 8.

In addition, bias VDC and shadow pulse are carriers for the 5 VDC voltage supplies, the print data, and the printhead controlling signals, as shown in FIG. 16.

In FIG. 8, power supply module 117, data interface module 118, and shadow pulse module 119 are respectively used to (1) shift the 5 VDC supply voltage 122 up to the magnitude of "bias VDC" (1,000 VDC), (2) shift 5 VDC logic-level signals 126,127,128 up to the magnitude of "bias VDC" (1,000 VDC), (3) shift shadow pulse Vs 130 up to the magnitude "bias" (1,000 VDC), and (4) shift print pulse Vp supply voltage 132 up to the level of "bias VDC+shadow pulse" (1,000 VDC+500 VDC).

FIG. 14 shows printhead module 120 of FIG. 8 in greater detail. FIG. 15 relates to a 64-nozzle printhead, and the 64 individual outputs 116 shown in FIG. 15 respectively connect to the 64 individual nozzles that are within the printhead. An integrated circuit chip 173 designated "UA Supertex HV3137" and three ICs, two of which are designated "HCPL 4661", and one of which is designated "UO 74LS243", are interconnected to provide the functions that are described relative to the FIG. 8 printhead module 120. At the upper portion of FIG. 15, the eight input signals to printhead module 120 are shown.

As will be appreciated by those of skill in the art, the above-described preferred embodiments of the invention can be modified to accommodate any number of supply voltages, voltage level shifts, logic lines, data lines, driver ICs, and printhead nozzles. Thus, it is not intended that the above-detailed description be taken as a limitation on the spirit and scope of the present invention.

What is claimed is:

1. In an electrostatic ink jet printer wherein electrostatic forces act on a plurality of liquid ink volumes contained within a plurality of closely spaced nozzles, wherein said nozzles are spaced the same distance from a print substrate that is at a reference potential and said electrostatic forces act between said plurality of nozzles and said print substrate, wherein a print data input defines a first group of nozzles as print-nozzles and defines a second group of nozzles as non-print-nozzles, and wherein a voltage above a given magnitude level relative to said reference-potential must be applied to said print-nozzles in order to cause ink to issue from of said print-nozzles and then impact said print substrate, the improvement comprising:

first electrical means for applying a bias-voltage to said print-nozzles and to said non-print-nozzles, said bias-voltage being of a given polarity relative to said reference-potential;

second electrical means controlled by said print data input for applying a shadow-voltage-pulse to said non-print-nozzles as an addition to said bias-voltage, said shadow-voltage-pulse being of a given magnitude and of said given polarity;

third electrical means controlled by said print data input for applying a print-voltage-pulse to said print-nozzles as an addition to said bias-voltage, said print-voltage-pulse being of a higher magnitude than said riven magnitude and of said given polarity;

a sum of said bias-voltage and said print-voltage-pulse being equal to or above said given magnitude level; and a sum of said bias-voltage and said shadow-voltage-pulse being high enough to reduce the magnitude of an electrostatic field that exists between said print-nozzles and said non-print-nozzles, while at the same time being low enough to prevent the issuance of ink from said non-print-nozzles.

2. The ink jet printer of claim 1, wherein said electrostatic field that exists between said print-nozzles and said non-print-nozzles is in a range of 50 VDC to 200 VDC.

3. The electrostatic ink jet printer of claim 1, wherein said plurality of closely spaced nozzles are arranged in an array, including:

a field compensation electrode bordering said array; and fourth electrical means for applying said sum of said bias-voltage and said shadow-voltage-pulse to said field compensation electrode.

4. The electrostatic ink jet printer of claim 1 including:

control signals and means connecting said control signals to said second electrical means and to said third electrical means for controlling application of said print-voltage-pulse and said shadow-voltage-pulse in accordance with said print data input.

5. The electrostatic ink jet printer of claim 1 wherein:

said bias-voltage is in a high-to-low magnitude range of 800 to 1200 VDC;

said sum of said bias-voltage and said shadow-voltage-pulse is in a corresponding high-to-low magnitude range of 1200 to 1800 VDC; and said sum of said bias-voltage and said print-voltage-pulse is in a corresponding high-to-low magnitude range of 1250 VDC to 2000 VDC.

6. An ink jet printer, comprising:

a plurality N of ink jet nozzles arranged in a linear nozzle array that extends in a row-direction;

a plurality N of liquid ink volumes, one of said ink volumes being located within each of said ink jet nozzles;

a print substrate occupying a first substrate position relative to said nozzle array when said print substrate is not in a print position relative to said nozzle array, and occupying a second substrate position relative to said nozzle array when said print substrate is in a print position relative to said nozzle array;

a source of print data specifying ink pixels that electronically define a print substrate image having a number of linear, spaced, and parallel print pixel rows that extend in a direction parallel to said row-direction;

first power supply means responsive to said print substrate occupying said first substrate position and operable to apply a bias voltage Vb to each of said ink jet nozzles;

second power supply means responsive to said print substrate occupying said second substrate position and responsive to said source of print data for applying a voltage equal to a sum of said bias voltage Vb and a shadow voltage Vs to a first plurality of said ink jet nozzles for which an ink pixel is not specified by said source of print data; and third power supply means responsive to said print substrate occupying said second substrate position and responsive to said source of print data for applying a voltage equal to a sum of said bias voltage Vb, said shadow voltage Vs, and a print voltage Vp to a second plurality of said ink jet nozzles for which an ink pixel is specified by said source of print data;

a voltage magnitude of said sum of said bias voltage Vb and said shadow voltage Vs being operable to produce an ink meniscus at said first plurality of ink jet nozzles; and a voltage magnitude of said sum of said bias voltage Vb, said shadow voltage Vs, and said print voltage Vp being operable to produce an ink filament at each of said second plurality of ink jet nozzles;

said ink filaments extending from said second plurality of ink jet nozzles to said print substrate.

7. The ink jet printer of claim 6, wherein:

said bias voltage Vb, said shadow voltage Vs, and said print voltage Vp are referenced to a potential equal to a potential of said print substrate.

8. The ink jet printer of claim 7, wherein:

said potential of said print substrate is ground potential;

said bias voltage Vb is in a range of 800 VDC to 1,200 VDC;

said shadow voltage Vs is in a range of 400 VDC to 600 VDC; and said print voltage Vp is in a range of 50 VDC to 250 VDC.

9. The ink jet printer of claim 8 including:

a field compensation electrode surrounding said nozzle array; and means connecting said field compensation electrode to said bias voltage Vb of said first power supply means.

10. An ink jet printer, comprising:

a plurality of ink jet nozzles arranged in a linear nozzle array that extends in a row direction;

a plurality of ink volumes with one ink volume located within each of said ink jet nozzles;

a ground potential print substrate adjacent to said nozzle array;

a print data signal specifying ink pixels that define an image to be printed on said print substrate, said image including physically spaced print pixel rows that extend parallel to said row direction;

a latch enable signal indicating said print substrate for receiving ink from said nozzle array;

a data interface module receiving as inputs said latch enable signal and said print data signal, said data interface module operating to provide a latch enable output, an output enable output, and a print data output;

a shadow pulse module receiving as an input said output enable output, said shadow pulse module operating to provide a shadow pulse output and a print output plus shadow pulse output;

a printhead module receiving as inputs said latch enable output, said print data output, said shadow pulse output, and said print output plus shadow pulse output; and means connecting an output of said printhead module to said nozzle array to apply said shadow pulse output to a first plurality of said nozzles for which an ink pixel is not specified by said print data signal, and to apply said print output plus shadow pulse output to a second plurality of said nozzles for which an ink pixel is specified by said print data signal.

11. The ink jet printer of claim 10 wherein:

said shadow pulse output is in a range of 1200 VDC to 1800 VDC relative to said ground potential, and said print output plus shadow pulse output is in a range of 1250 VDC to 2000 VDC relative to said ground potential.

12. The ink jet printer of claim 11 including:

a field compensation electrode surrounding said nozzle array; and connecting means connecting said field compensation electrode to said shadow pulse output.

13. In an ink jet printer having a plurality of ink jet nozzles arranged in a linear nozzle array extending in a row direction, a plurality of ink volumes with one ink volume being located within each of said nozzles, a ground potential print substrate, a logic level print data signal that specifies pixels defining an ink image to be printed on said print substrate by said nozzle array, said ink image having parallel print pixel rows that are physically spaced from each other and that extend in said row direction, a logic level output enable signal indicative of a said print substrate to be printed, a logic level latch enable signal indicative of said print substrate occupying a position to receive a print pixel row of said ink image, and a driver network for (1) applying a "bias VDC" potential to said nozzle array when said print substrate is not in said position to receive a print pixel row of said ink image, for (2) applying a non-print potential to a first portion of said nozzle array for which an ink pixel is not specified by said print data signal when said print substrate occupies said position to receive a print pixel row of said ink image, and for (3) applying a print potential to a second portion of said nozzle array for which an ink pixel is specified by said print data signal when said print substrate occupies said position to receive a print pixel row of said ink image, an electronic network comprising:

a first signal generating means receiving as inputs said print data signal, said output enable signal, and said latch enable signal;

said first signal generation means responding to said print data signal, said output enable signal, and said latch enable signal, and operating to generate a "print data+bias VDC" output signal, an "output enable+bias VDC" output signal, and a "latch enable+bias VDC" output signal;

second signal generating means receiving as an input said "output enable+bias VDC" output signal;

said second signal generating means responding to said "output enable+bias VDC" output signal, and operating to generate a "bias VDC+shadow pulse" output signal, and a "bias VDC+shadow pulse+print pulse" output signal; and first connecting means connecting said "print data+bias VDC" output signal, said "latch enable+bias VDC" output signal, said "bias VDC+shadow pulse" output signal, and said "bias VDC+shadow pulse+print pulse" output signal in controlling relation to said driver network;

said driver network being responsive to said "print data+bias VDC" output signal, said "latch enable+bias VDC" output signal, said "bias VDC+shadow pulse" output signal, and said "bias VDC+shadow pulse+print pulse" output signal, and operating to provide said "bias VDC+shadow pulse" output signal as said non-print potential to said first portion of said nozzle array; and to provide to provide said "bias VDC+shadow pulse+print pulse" output signal as said print potential to said second portion of said nozzle array.

14. The ink jet printer of claim 13 wherein:

said "bias VDC" potential is in a range of from 800 VDC to 1,200 VDC;

said "bias VDC+shadow pulse" output signal is in a range of from 1200 VDC to 1800 VDC; and said "bias VDC+shadow pulse+print pulse" output signal is in a range of from 1250 VDC to 2000 VDC.

15. The ink jet printer of claim 13:

wherein said first and second signal generating means comprise semiconductor means requiring an operating voltage of 5 VDC;

wherein said logic level output enable signal and said logic level latch enable signal are both 5 VDC signals;

wherein said first signal generating means receives operating voltage of 5 VDC from a source that comprises "bias VDC"+5 VDC, referenced to "bias VDC"; and wherein said second signal generating means receives operating voltage of 5 VDC from a source that comprises "bias VDC"+logic level output enable signal, referenced to "bias VDC".

16. The ink jet printer of claim 13 including:

a field compensation electrode surrounding said nozzle array, and second connecting means connecting said field compensation electrode to said "bias VDC+shadow pulse" output signal.

17. The ink jet printer of claim 16:

wherein each of said nozzles and said field compensation electrode are formed of metal and occupy a common plane that is parallel to at least a portion of said print substrate;

wherein each of said nozzles and said field compensation electrode are spaced 1 millimeter from said at least a portion of said print substrate;

wherein each of said nozzles has a circular cross section;

wherein said nozzles are spaced 1 millimeter center-to-center; and wherein each of said nozzles has a 150 micrometer inner diameter and a 200 micrometer outer diameter.

18. In an electrostatic ink jet printer wherein electrostatic forces act on a plurality of liquid ink volumes contained within a plurality of closely spaced nozzles, wherein each of said nozzles are spaced generally the same distance from a print substrate that is at a reference potential, wherein said electrostatic forces act between said plurality of nozzles and said print substrate, wherein a print data input defines a first group of nozzles as print nozzles and defines a second group of nozzles as non-print nozzles, and wherein a voltage above a given magnitude relative to said reference potential must be applied to said print nozzles in order to cause ink to issue from of said print nozzles and then impact said print substrate, the improvement comprising:

first electrical means for applying a bias voltage to said print nozzles and to said non-print nozzles, said bias voltage being of a given polarity relative to said reference potential;

second electrical means controlled by said print data input for applying a shadow voltage pulse to said non-print nozzles as an addition to said bias voltage, said shadow voltage pulse being of said given polarity and having a given magnitude;

third electrical means controlled by said print data input for applying a print voltage pulse to said print nozzles as an addition to said bias voltage, said print voltage pulse being of said given polarity and being of a higher magnitude than said given magnitude of said shadow voltage pulse;

a sum of said print voltage pulse and said bias voltage being of a magnitude that is equal to or above said given magnitude; and a sum of said shadow voltage pulse and said bias voltage being high enough to reduce an electrostatic field that exists between said print nozzles and said non-print nozzles, while at the same time being low enough to prevent issuance of ink from said non-print nozzles.

19. The ink jet printer of claim 18, wherein said electrostatic field that exists between said print nozzles and said non-print nozzles is in a range of 50 VDC to 200 VDC.

20. The electrostatic ink jet printer of claim 18, wherein said plurality of closely spaced nozzles are arranged in an array, including:

a field compensation electrode bordering said array; and fourth electrical means applying said sum of said bias voltage and said shadow voltage pulse to said field compensation electrode.

21. The electrostatic ink jet printer of claim 18, wherein:

said bias voltage is in a high-to-low magnitude range of 800 to 1200 VDC;

said sum of said bias voltage and said shadow voltage pulse is in a corresponding high-to-low magnitude range of 1200 to 1800 VDC; and said sum of said bias voltage and said print voltage pulse is in a corresponding high-to-low magnitude range of 1250 VDC to 2000 VDC.

* * * * *